US011559980B2

(12) United States Patent
Heinze

(10) Patent No.: US 11,559,980 B2
(45) Date of Patent: Jan. 24, 2023

(54) DRYER

(71) Applicant: Bobst Bielefeld GmbH, Bielefeld (DE)

(72) Inventor: Rene Heinze, Vlotho (DE)

(73) Assignee: BOBST BIELEFELD GMBH, Bielefeld (DE)

( * ) Notice: Subject to any disclaimer, the term of this patent is extended or adjusted under 35 U.S.C. 154(b) by 198 days.

(21) Appl. No.: 16/976,051

(22) PCT Filed: Feb. 26, 2019

(86) PCT No.: PCT/EP2019/025053
§ 371 (c)(1),
(2) Date: Sep. 14, 2020

(87) PCT Pub. No.: WO2019/166129
PCT Pub. Date: Sep. 6, 2019

(65) Prior Publication Data

US 2021/0001620 A1 Jan. 7, 2021

(30) Foreign Application Priority Data

Feb. 27, 2018 (EP) ..... 18020082

(51) Int. Cl.

| | |
|---|---|
| ***B41F 23/04*** | (2006.01) |
| ***F26B 13/10*** | (2006.01) |
| ***F26B 21/00*** | (2006.01) |
| ***F26B 21/02*** | (2006.01) |

(52) U.S. Cl.
CPC ..... *B41F 23/0426* (2013.01); *F26B 13/108* (2013.01); *F26B 21/004* (2013.01); *F26B 21/02* (2013.01)

(58) Field of Classification Search
CPC .. B41F 23/0426; B41F 23/043; F26B 13/108; F26B 21/004; F26B 21/02; F26B 21/028
USPC ..... 34/638, 639, 541, 585
See application file for complete search history.

(56) References Cited

U.S. PATENT DOCUMENTS

| | | | | |
|---|---|---|---|---|
| 3,494,048 | A * | 2/1970 | Fresne | F26B 13/007 34/454 |
| 2010/0199510 | A1* | 8/2010 | Plavnik | F26B 21/004 34/68 |
| 2011/0017083 | A1 | 1/2011 | Melotti et al. | |
| 2012/0246966 | A1 | 10/2012 | Straetmans et al. | |

FOREIGN PATENT DOCUMENTS

| | | | |
|---|---|---|---|
| CN | 2363255 | Y | 2/2000 |
| CN | 1464965 | A | 12/2003 |
| CN | 101830104 | A | 9/2010 |

(Continued)

OTHER PUBLICATIONS

International Search Report dated Aug. 14, 2019, in counterpart International Patent Application No. PCT/EP2019/025053 (4 pages, in English).

*Primary Examiner* — John P McCormack
(74) *Attorney, Agent, or Firm* — Bookoff McAndrews, PLLC

(57) ABSTRACT

The present invention relates to a dryer for treating a moving printing web in a rotary printing press with gas, having a nozzle body. The dryer according to the invention is characterized in that the nozzle body has at least one opening for the exit of heated gas and has at least one opening for recirculating the cooled gas.

20 Claims, 4 Drawing Sheets

(56) References Cited

FOREIGN PATENT DOCUMENTS

| | | | | | |
|---|---|---|---|---|---|
| CN | 103748429 | A | | 4/2014 | |
| CN | 105398205 | A | | 3/2016 | |
| CN | 105398206 | A | | 3/2016 | |
| DE | 1902113 | A1 | | 9/1969 | |
| DE | 19915923 | A1 | * | 11/2000 | ..... F26B 21/02 |
| DE | 20201610278 | U1 | | 8/2017 | |
| EP | 0103876 | A2 | * | 9/1983 | ..... B41F 23/04 |
| EP | 0103876 | A2 | | 3/1984 | |
| EP | 0647524 | A1 | | 4/1995 | |
| EP | 3112156 | A1 | | 5/2018 | |

* cited by examiner

DRYER

CROSS-REFERENCE TO RELATED APPLICATION(S)

This application is a National Stage under 35 U.S.C. § 371 of International Application No. PCT/EP2019/025053, filed on Feb. 26, 2019, which claims priority to European Patent Application No. 18020082.6, filed on Feb. 27, 2018, the contents of all of which are incorporated by reference in their entirety.

The invention relates to a dryer for treating a running printing web with gas in a rotary printing press, having a nozzle body.

Rotary printing presses are essentially printing presses in which printing webs or material webs located on rolls are unrolled and printed and then rolled up again. The printing presses are conceived for different materials, for example, paper or film. Furthermore, different inks are used, such as solvent inks, water-based inks, or indicator inks.

In rotary printing presses, drying nozzles are used to dry the printing ink of the images printed on the printing web. For this purpose, a drying gas is introduced into a nozzle body, the nozzle slot of which is oriented toward the printing web, so that the printing web is treated as uniformly as possible with the drying gas over its entire width and is thus dried.

Furthermore, using a sheet metal body which is divided into two chambers as a dryer is known. One chamber (supply air chamber) guides the heated gas to the material web to be dried, the other chamber (exhaust air chamber) guides the air enriched with solvent or water away from the interior web. A so-called nozzle lance is located in the supply air chamber, which can be removed from the chamber for cleaning. This lance consists of a 5 mm wide slot from which the gas flows to the material web. In addition to the wedge-shaped shape, small baffles have been incorporated so that better air flow is achieved.

A drying nozzle with a hollow nozzle body is known from DE 20 2016 102 780, for example, wherein the nozzle body has a nozzle slot extending transversely to the running direction of the printing material web. In order that the drying nozzle may be adapted easily to different applications, the nozzle body has an inner tube and an outer tube surrounding the inner tube, which each have at least one outlet opening in its circumferential wall, and the nozzle slot is formed by an overlap zone of the outlet openings of the inner tube and the outer tube and is adjustable by changing the angular position of the inner tube in relation to the outer tube.

An arrangement of multiple nozzles extending in succession over the entire width of the printing web is known from EP 3 112 156 A1. This arrangement is very large and is therefore only suitable for use as a post-drying arrangement.

In the dryers known from the prior art, it has furthermore proven to be disadvantageous that the irregularity of the airflow results in an uneven drying result. This means the ink has a different "drying level" with respect to the width of the material web. In addition, the material web travels back and forth on the cylinder in the case of drying performance required by computer, whereby matching variations/register variations result in the printing process, which significantly reduce the printing quality. The result is that the required drying power cannot be set and the actual possible performance of the drying is thus not achieved.

The object of the invention is to provide a dryer which is capable of operating at lower gas speeds/pressures and thus lower performances.

This object is achieved according to the invention in that the nozzle body as at least two openings extending over only a part of a width of the printing web for the exit of heated gas and has at least one opening for recirculating the cooled gas.

Using a dryer according to the present invention, better dryer properties can now be achieved in a simple manner, which are essentially independent of the material to be printed.

In this way, a uniform airflow can advantageously be achieved over the entire printing web with relatively little space required, which leads to a uniform drying result. Significantly less turbulence, which does not influence the material web, occurs due to the homogeneous air guiding. The dryer increases the printing quality enormously due to this property. In comparison to conventional dryers, it is now additionally possible to install it and remove it for cleaning purposes without dismantling further components. Due to the modular structure, individual components may be removed and under certain circumstances this may even be done without tools.

It has proven to be particularly advantageous if the openings are arranged at least partially offset. It is thus possible that every region of the printing web is also dried.

Good results can be achieved if the at least one opening as a round or oval shape or shape approximating such a shape. The openings can all have the same shape or different shapes. Good results have been achieved, for example, with openings which have an outlet opening in the range of 1 to 10 mm, preferably 2 to 5 mm.

According to one preferred embodiment of the invention, the dryer is designed in such a way that the nozzle body has a cavity, through which the heated gas is supplied to the printing web. In this way, for example, a fitting can be provided for supplying the heated gas to the nozzle body, by which the heated gas is supplied into the cavity.

It has proven to be advantageous if the at least one opening for the exit of heated gas protrudes from a circumferential surface of the nozzle body. It can be ensured in this way that the heated gas is supplied directly to the printing web.

According to a further advantageous design of the invention, the one opening for recirculating the cooled gas is provided outside the cavity. It is thus possible, for example, to draw off the cooled gas along the nozzle body and laterally.

It can be advantageous here that a suction unit is provided for recirculating the cooled gas.

Good results have been achieved when ambient air is used as the gas.

To achieve particularly good drying results, it can be advantageous for the nozzle body to have essentially at least the width of the printing web.

According to a further aspect, the present invention relates to a method for drying a moving printing web in a rotary printing press, wherein the running printing web is dried by means of heated gas from a dryer having a nozzle body, the cooled gas is returned into the dryer at least partially along the surface of the nozzle body opposite to the printing web, and wherein there is a negative pressure at least essentially in the region between the exit of the heated gas and the printing web. This negative pressure ensures that contamination of the environment can be greatly reduced or even prevented.

Such a method can provide good drying results in particular if the negative pressure is present permanently and uniformly during operation.

Good results can be achieved in a cost-effective manner if ambient air is used as the gas.

According to one particularly preferred embodiment of the present invention, the cooled gas is recirculated by means of suction.

In addition, it can be provided that the cooled gas is supplied to filtration. In this way, it would be possible to reuse the gas or return it into the atmosphere.

The dryer according to the present invention can be used in particular as an intermediate drying nozzle in a rotary printing press.

According to still a further aspect, the invention relates to a rotary printing press comprising a printing cylinder for printing a moving printing web and a dryer for treating the printing web with gas, having a nozzle body, characterized in that the nozzle body has at least two openings extending over only a part of a width of the printing web for the exit of heated gas and has at least one opening for recirculating the cooled gas, wherein there is a negative pressure at least essentially in the region between the exit of the heated gas and the printing web.

In the following, exemplary embodiments of the invention are explained in greater detail on the basis of the drawings.

In the drawings:

FIG. 1 shows a perspective view of a nozzle body 1 according to one preferred embodiment of the invention, wherein the structure thereof is represented as an intermediate drying nozzle in the following by way of example. The dryer consists according to the embodiment shown of a so-called excess pressure region and a negative pressure region.

Figure 1:
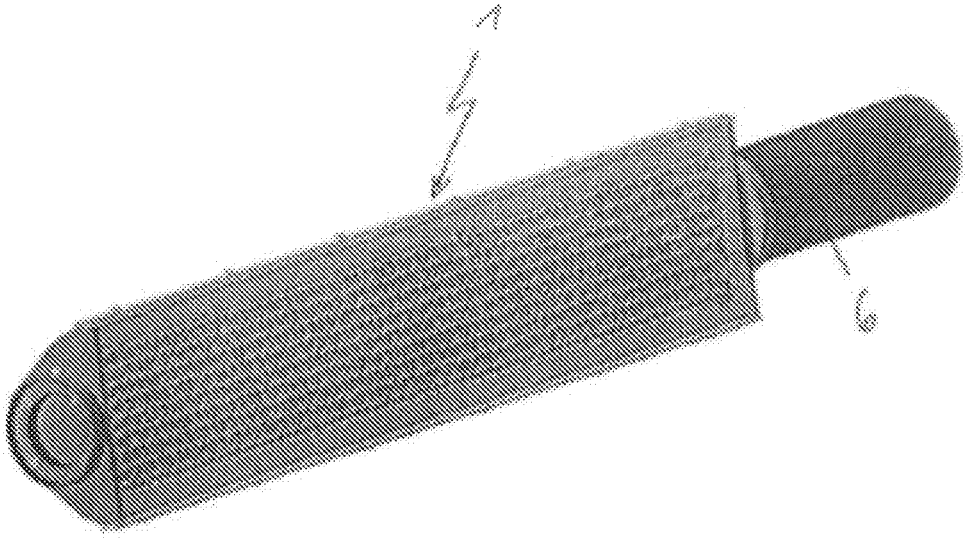
FIG. 1 shows a perspective view of a nozzle body according to one preferred embodiment of the invention.
Figure 2:
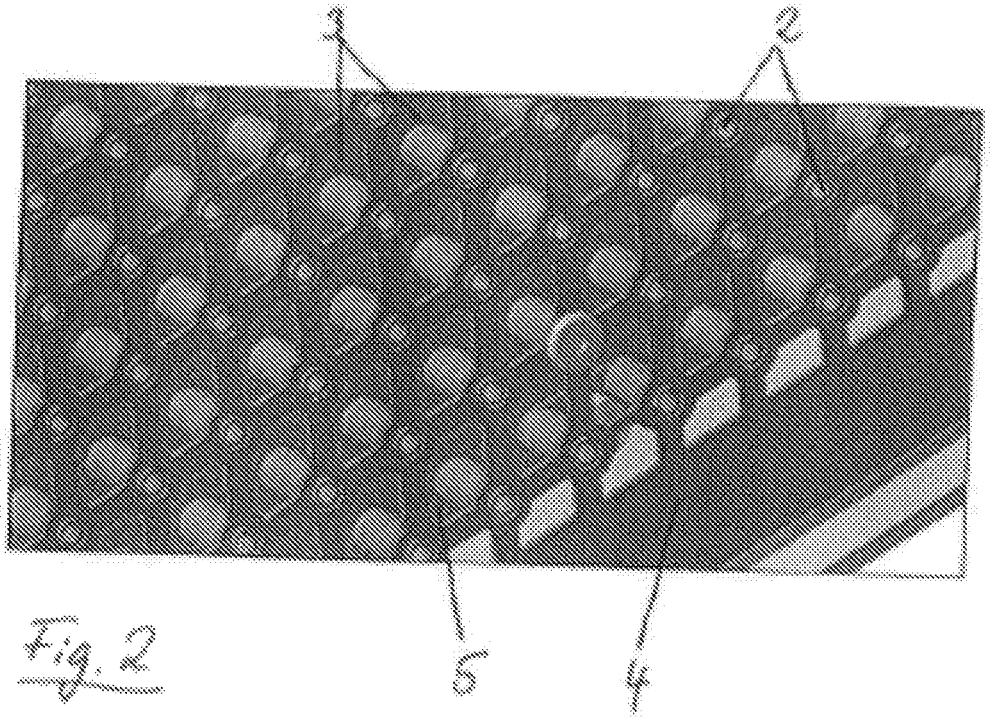
FIG. 2 shows a detailed view of the nozzle body according to one preferred embodiment of the invention.

The heated gas required for drying, for example, air, flows out of openings 2 which protrude from the nozzle main body 5 and are formed as nozzles, small "holes" here, is incident on the freshly printed material web or printing web, and is suctioned in again by other provided openings 3. It is thus possible to prevent air-solvent mixture from reaching the atmosphere. The openings can be seen well in FIG. 2, a detailed view. FIG. 1 shows the region out of which the air flows and is simultaneously suctioned in again. The structure of the drying nozzle is visible from the zoom view of FIG. 2.

In the embodiment shown, a type of plate 4 is provided on the nozzle body, which is formed here as a grid plate, which is fastened by means of rivets, for example, on the base body 5, which is milled, for example. This base body 5 is in turn fastened in a main frame, for example, by means of screws.

According to the illustrated preferred embodiment, there is a uniform permanent negative pressure in the region between dryer and counter pressure cylinder, which prevents the solvent-laden air from flowing into the environment, on the one hand, and suctions in and discharges the solvent-laden air from the entire printing unit, on the other hand.

Figure 7:
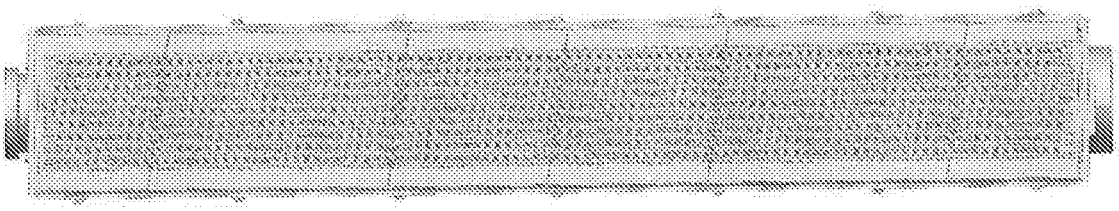
FIG. 7 shows a completely assembled nozzle body in a top view.

FIG. 7 shows a nozzle body in a view of the outlet nozzles. In this case, the nozzles are the openings 2, which have an essentially round shape and are all designed essentially the same. The openings are arranged transversely in the direction of movement of the printing web in a kind of line, while they are arranged offset at an angle in the movement direction of the printing web. The angle can be in a range of 2 to 30°, preferably 5 to 15° here.

Figure 3:
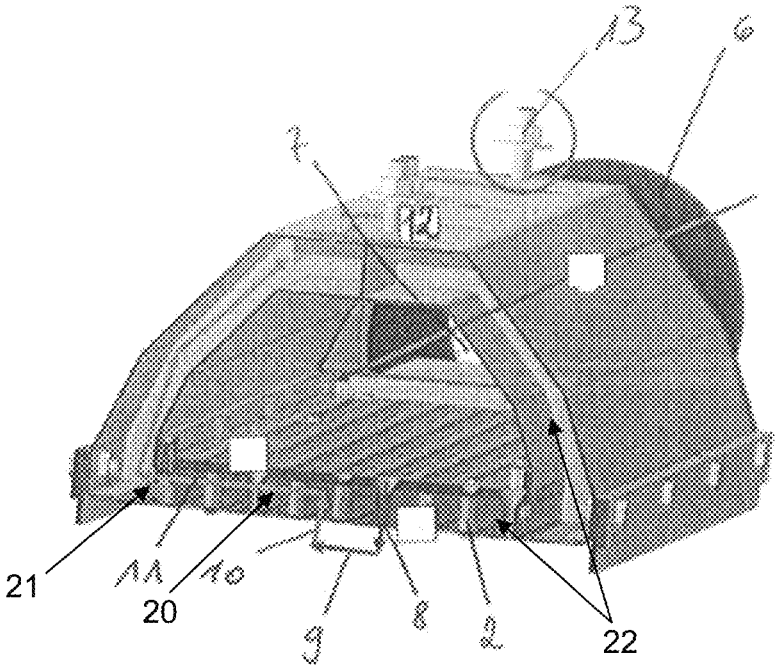
FIG. 3 shows a perspective sectional view of the nozzle body according to one preferred embodiment of the invention.
Figure 4:
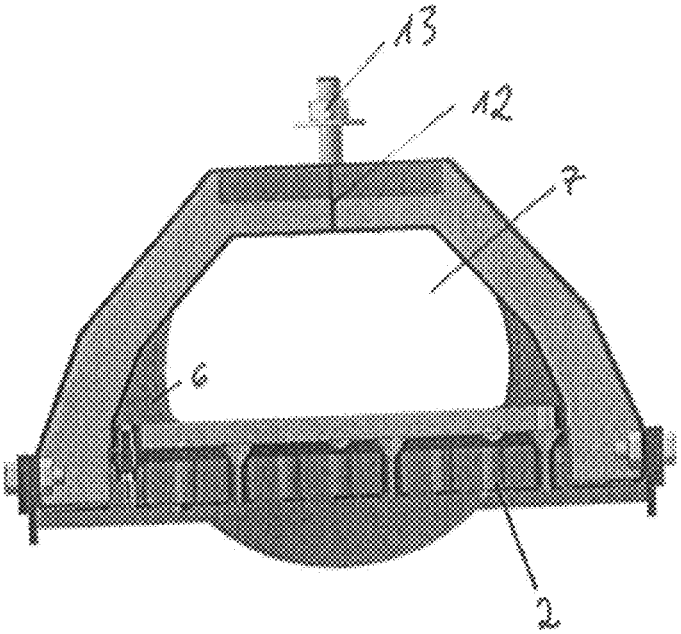
FIG. 4 shows a cross section of the nozzle body of FIG. 3.

An exemplary structure of a nozzle body 1 is shown in a perspective view in FIG. 3. FIG. 4 shows a cross section of this nozzle body.

The air, which is either already heated or is still being heated, passes through a connecting piece 6 into the cavity 7 of the nozzle body 1 or the excess pressure region. The air leaves this through the small outlet openings 2 (arrow 8), strikes against the material of the web to be printed, reverses (arrow 10), and reaches a recirculating opening 21 in the lateral ends 11 by passing through the inlet openings 3 and then through transverse openings 20, where the inlet openings 3 are openings in the plate 4 and the transverse openings 20 are openings between the nozzles in a channel 22 outside the cavity 7 and inside the plate 4, in the milled base body (arrows 9 and 10). Arriving there, the medium flows "above" the excess pressure region or past the excess pressure region in the direction of the suction opening, or suction outlet, 12. Preferably so-called stud bolts 13, to which the air suction unit is attached, are located above this suction opening. Depending on the width of the nozzle, the air suction unit consists of different screwed-on connecting pieces. A flexible, solvent-resistant, and heat-resistant hose is attached to these connecting pieces, which transports the solvent-laden air to a manifold.

Figure 5:
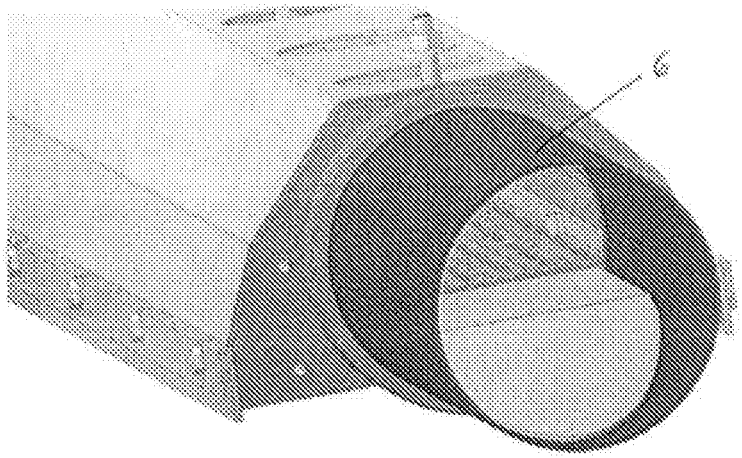
FIG. 5 shows a detailed view of the nozzle body of FIG. 1.

FIG. 5 shows a detailed view of the nozzle body 1 from FIG. 1, the inlet or connecting piece for the heated air or gas or air or gas to be heated is shown here.

Figure 6:
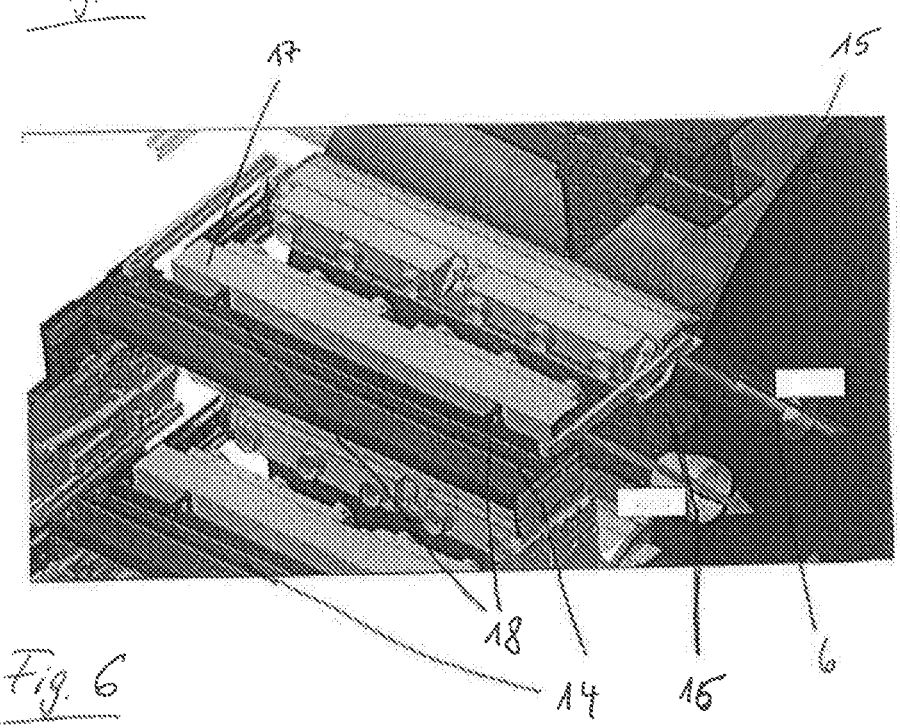
FIG. 6 shows a dryer according to a further preferred embodiment in an installed state.

FIG. 6 shows a dryer according to a further preferred embodiment in an installed state.

It can be seen that the entire drying unit is arranged here, for example, between a cross member 14 and a central cylinder 15 in a rotary printing press. Two dryers are visible for this purpose in FIG. 6, wherein more dryers can also be arranged. The nozzle body 1 is fastened by means of a holder 16 in a printing unit. According to the embodiment shown, a manifold 17, in which the exhaust air is discharged, is located on plate holders 18, which are suspended in the cross member 14. By using flexible hoses to connect the nozzle body 1 to the manifold 17, it is possible, for example, to move/pull the nozzle body somewhat in the direction of the cross member, to be able to remove material residues which have caught on the plate.

As can be seen clearly from FIG. 6, it is additionally possible using a dryer according to the present invention, due to the modular structure, to install it and remove it in and from the printing unit for cleaning purposes without dismantling further components. With appropriate attachments, individual components may also be installed without tools due to the modular structure.

The invention claimed is:

1. A dryer for a printing press, the dryer comprising:

a nozzle body, wherein the nozzle body has a cavity to receive heated gas and at least two nozzles with outlet openings extending from the cavity over only part of a width of a printing web for an exit of heated gas from the nozzle body in a first direction;

at least one inlet opening in the nozzle body between the at least two nozzles for the heated gas that exited the nozzle body to return as return gas into the nozzle body and flow in a path outside the cavity;

at least one transverse opening for the return gas to flow inside the nozzle body past at least one nozzle of the at least two nozzles in a second direction transverse to the first direction; and at least one recirculating opening for recirculating the return gas from the at least one transverse opening through the nozzle body along a path inside the nozzle body and outside the cavity to a suction opening of the nozzle body.

2. The dryer as claimed in claim 1, wherein the at least two nozzles with outlet openings are arranged at least partially offset.

3. The dryer of claim 1, wherein the outlet openings have a round or oval shape or a shape approximating such a shape.

4. The dryer of claim 1, wherein the at least one recirculating opening includes an opening on opposite ends of the nozzle body.

5. The dryer of claim 1, wherein the nozzle body has a circumferential surface, and the at least two nozzles with outlet openings for the exit of the heated gas protrude from the circumferential surface of the nozzle body.

6. The dryer of claim 1, wherein an entrance of the at least one recirculating opening for recirculating the return gas is provided outside the cavity.

7. The dryer of claim 1, wherein a suction unit is connected to the suction opening for recirculating the return gas.

8. The dryer of claim 1, wherein the nozzle body has at least the width of the printing web.

9. A method for drying a running printing web in a rotary printing press, wherein the running printing web is dried by heated gas from the dryer as claimed in claim 1, wherein the return gas is at least partially returned into the dryer along a surface of the nozzle body opposite to the printing web, and there is a negative pressure at least in a region between an exit of the heated gas and the printing web.

10. The method of claim 9, wherein the negative pressure is present during operation.

11. The method of claim 9, wherein ambient air is used as the heated gas.

12. The method of claim 9, wherein the return gas is returned by suction.

13. The method of claim 9, wherein the return gas is supplied to filtration to reuse the return gas or return the return gas into the atmosphere.

14. A use of the dryer as claimed in claim 1 as a drying nozzle in a rotary printing press.

15. A rotary printing press comprising:

a printing cylinder for printing a moving printing web, and the dryer as claimed in claim 1, wherein there is a negative pressure at least in a region between an exit of the heated gas and the printing web.

16. A dryer for a printing press, the dryer comprising:

a cavity to receive gas;

a nozzle outside the cavity and in fluid communication with the cavity to exhaust gas from the cavity in a first direction;

an inlet outside the cavity to draw the exhausted gas from the nozzle in a second direction opposite to the first direction; and a recirculating inlet on an opposite side of the nozzle from the inlet to draw the gas from the inlet past the nozzle in a third direction transverse to the second direction.

17. The dryer of claim 16, further comprising:

a suction outlet in fluid communication with the recirculating inlet to draw the gas from the recirculating inlet along a path inside the dryer and outside the cavity.

18. A dryer for a printing press, the dryer comprising:

an inner wall forming a cavity;

an outer wall surrounding the inner wall and forming a channel between the inner wall and the outer wall;

a nozzle in the channel and in fluid communication with the cavity to exhaust gas from the cavity in a first direction;

an inlet in the channel to draw the exhausted gas from the nozzle into the channel in a second direction opposite to the first direction; and a suction outlet to draw air from the inlet in a third direction.

19. The dryer of claim 18, wherein the third direction is transverse to a direction of travel of printing material through the dryer.

20. The dryer of claim 18, wherein the channel surrounds the cavity.

* * * * *